US005645790A

United States Patent [19]

Schwarz et al.

[11] Patent Number: 5,645,790

[45] Date of Patent: Jul. 8, 1997

[54] APPARATUS AND PROCESS FOR POLYGONAL MELT-BLOWING DIE ASSEMBLIES FOR MAKING HIGH-LOFT, LOW-DENSITY WEBS

[75] Inventors: Eckhard C. A. Schwarz; Douglas B. Brown; Michael S. Angell, all of Neenah, Wis.

[73] Assignee: Biax-Fiberfilm Corporation, Neenah, Wis.

[21] Appl. No.: 603,735

[22] Filed: Feb. 20, 1996

[51] Int. Cl.[6] ..... D01D 5/08; D04H 3/03

[52] U.S. Cl. ..... 264/555; 156/433; 156/441; 264/211.14; 425/72.2; 425/464

[58] Field of Search ..... 264/103, 211.14, 264/555; 425/72.2, 464; 156/433, 441

[56] References Cited

U.S. PATENT DOCUMENTS

| | | | |
|---|---|---|---|
| 4,048,364 | 9/1977 | Harding et al. | 428/113 |
| 4,380,570 | 4/1983 | Schwarz | 428/296 |
| 5,326,241 | 7/1994 | Rook et al. | 425/72.2 X |
| 5,476,616 | 12/1995 | Schwarz | 264/6 |

*Primary Examiner*—Leo B. Tentoni

*Attorney, Agent, or Firm*—Eckhard C. A. Schwarz

[57] ABSTRACT

There is disclosed a novel apparatus and process for melt-blowing fiberforming thermoplastic polymers at high rates to form high-loft, low density fine fiber webs suitable for insulation applications. The high rates are achieved by mounting melt-blowing spinnerettes on the surfaces of a polygonal cylinder and spinning fibers in a radial fashion, then deflecting the fiber streams 90 degrees by a secondary stream of cold air.

6 Claims, 4 Drawing Sheets

APPARATUS AND PROCESS FOR POLYGONAL MELT-BLOWING DIE ASSEMBLIES FOR MAKING HIGH-LOFT, LOW-DENSITY WEBS

BACKGROUND OF THE INVENTION.

This invention relates to improvements of melt-blowing processes and apparatuses applying to multiple rows of spinning orifices describes in U.S. Pat. No. 4,380,570 and 5,476,616, which are herewith incorporated as reference. More particularly, it relates to the improvement whereby melt-blowing spinnerettes are mounted on the surfaces of a polygonal melt-blowing extrusion die block thereby spinning thermoplastic fibers away from the center of the polygon at high extrusion rates, said fibers are then being deflected about 90 degrees by an air stream from a circular or polygonal air ring to enhance fiber entanglement and web formation of high bulk and low density.

OBJECTS OF THE INVENTION

It is an object of the present invention to increase the productivity of a melt-blowing extrusion die and enhance the fiber entanglement by an air stream directed at an angle at the melt-blown fibers to form a fiber web of high bulk and low density.

Another object of the invention is to obtain a fiber web of high compression recovery by adding a binder such as adhesive latex or thermoset phenol-formaldehyde or resorcinol-formaldehyde to said deflecting air stream to form an adhesive spray, thus binding the fiber cross-over points and producing a rigid web structure in a subsequent curing step.

SUMMARY OF THE INVENTION

These and other objects of the invention are achieved by mounting melt-blowing spinnerettes vertically on the surfaces of a polygonal cylinder, thereby melt-blowing fibers radially away from the center of the polygon horizontally in a radial fashion, the deflecting the radial fiber stream downward by means of a circular air or air/adhesive spray stream from one or more circular or polygonal air spray tubes, thus forming a highly entangled and/or bonded fiber web of high bulk and low density.

BRIEF DESCRIPTION OF THE DRAWINGS

A better understanding of the present invention as well as other objects and advantages thereof will become apparent upon consideration of the detailed disclosure thereof, especially when taken with the accompanying drawing, wherein like numerals designate like parts throughout.

DETAILED DESCRIPTION OF THE INVENTION

Figure 1:
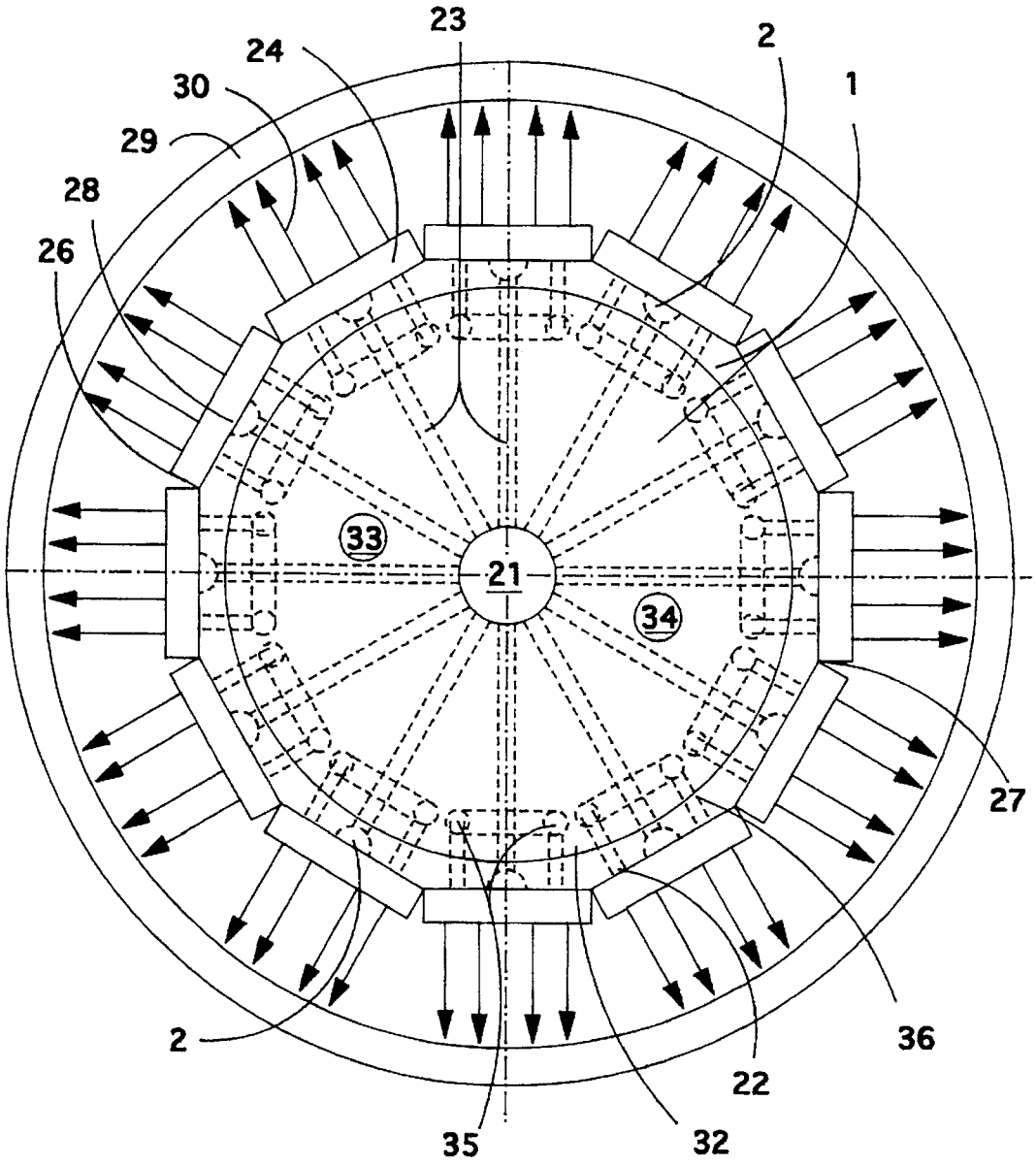
FIG. 1 is a schematic top view of a polygonal die block having twelve spinnerettes mounted circumferentially, and showing the radial fiber spinning towards the circular air deflector tube.
Figure 2:
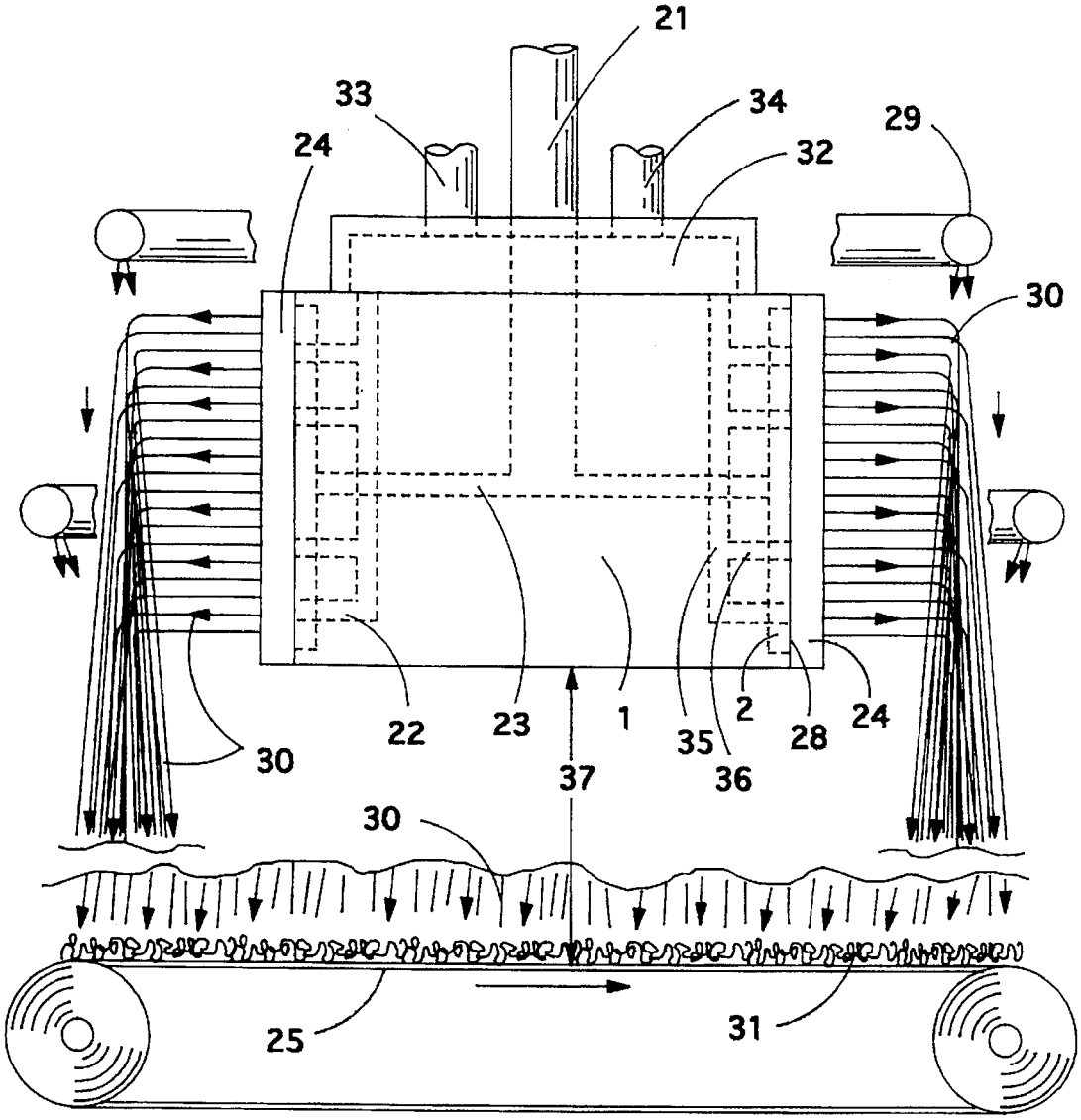
FIG. 2 is across sectional side view of the same die block, showing the downward deflection of the fiber stream.

It has been found in previous melt-blowing assemblies such as described in U.S. Pat. Nos. 4,380,570 and 5,476,616, that capacities for making fine fibers were limited by the number of spinning orifices over the width of an extrusion die from 20 spinning orifices per inch width of extrusion die head (U.S. Pat. No. 4,048,364, col. 5, line 55) to 177 orifices per inch width (U.S. Pat. No. 5,476,616, col. 4, line 23, Table 1, Example 9). In the present invention this orifice density can be increased to about 888 spinning orifices per linear inch width of extrusion die by using the following arrangement in Example 1 of this specification: A dodecagonal fixed die head 1 shown in FIG. 1 and 2 is mounted over a moving collecting screen 25. The die head has a diameter from edge 26 to edge 27 of 13,525 inches, and has 12 vertical surfaces 28 of 3.5×10 inches, each having eight rows of spinning orifices in a spacing as described in U.S. Pat. No. 5,476,616, col. 4, line 23, Table 1, Example 9. The total number of spinning orifices of this die block is approximately 21,333. The air ring 29 of dimeter of 24 inches is blowing fibers 30 onto the collecting screen 25 which moves the fiber web 31 toward a winding device at a constant speed. The web 31 of 24 inches width is produced by the 21,888 spinning orifices, or 888 spinning orifices per inch width of collected web 31. The 90 degree fiber deflection by the air stream from air ring 29 yielded a much bulkier web than when blown straight onto a collection device as described in Example 1. Polymer is moved under pressure from an extruder or other supply device into the main polymer cavity 21 of the die block 1 to the twelve distribution channels 23, which feed the spinnerette supply cavity 2. The polymer then enters the twelve spinnerette 24, one of which is depicted in FIG. 3 in detail.

Hot pressurized gas is fed from a hot gas supply system to the gas manifold 32 though pipes 33 and 34, the manifold 32 is connected to the gas channels 35, which feed gas through channels 36 and 22 to the spinnerette gas inlet 7.

Figure 3:
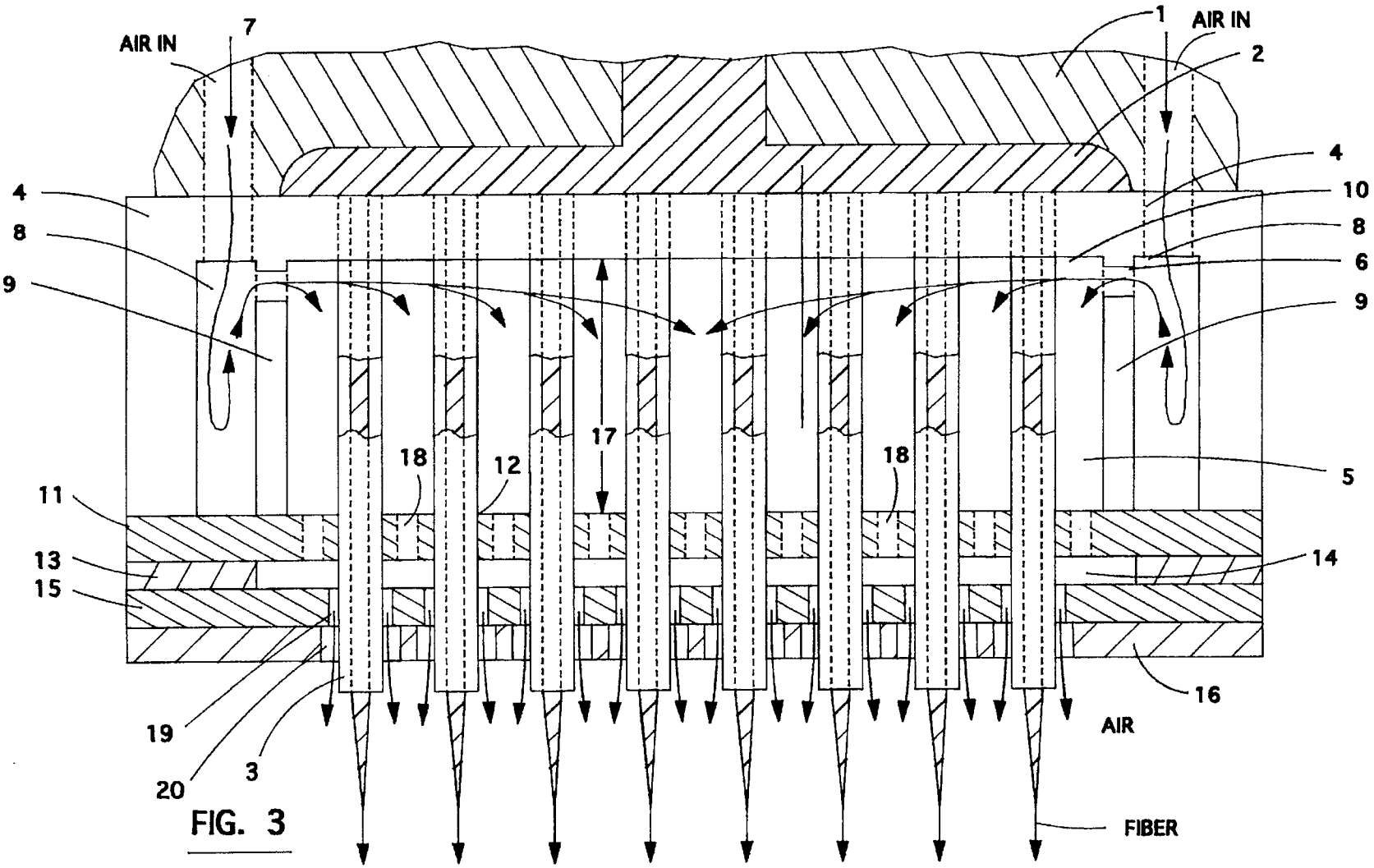
FIG. 3 is a cross sectional top view of a melt-blowing spinnerette, showing the flow of polymer, air, and fibers.

Referring now to FIG.3, The spinnerette assembly is mounted on the die body 1 which supplies polymer melt to a supply cavity 2 feeding the spinning nozzles 3 which are mounted in the spinnerette body plate wherein nozzles 3 are spaced from each other at a distance of at least 1.3 times the outside diameter of a nozzle 3. The nozzles 3 lead through the gas cavity 5, which is fed with hot gas, air, or other suitable fluids from the gas inlet slot 6. The primary supply gas enters the spinnerette assembly through inlet channel 7 into a supply cavity 8 which is in the form of a first gas cavity having a height of at least six times the outside diameter of a nozzle 3. The baffle plate 9 diverts the gas stream and forces the gas through the slot 6 toward the base 10 of the nozzle 3. The nozzles 3 protrude through gas cover plate 11 through tight fitting holes 12 arranged in the same pattern as the nozzle mounts in spinnerette body plate 4. The gas cover plate family further consists of spacer plate 13 which forms a second gas cavity 14 between plates 11 and 15, said second gas cavity having a height of at least one half of the diameter of a nozzle 3, and wherein first gas plate 11, spacer plate 13, and second gas plate 15 have a total combined thickness of less than ten times the outside diameter of a nozzle 3. Another gas cover plate 16 is sometimes added to the assembly to facilitate expansion of the gas to attenuate the fibers exiting the nozzles 3. The complete path of the gas is now from inlet channel 7 into the gas supply cavity 8 through inlet slot 6 into the gas cavity 5 which has a specific height of 17. The gas then flows through gas holes 18 of plate 11 into the gas cavity 14 and then around the nozzles 3 through holes 19 and 20, in which the nozzles 3 are centered. The gas inlet slot 6 can be replaced by a series of holes having a similar total cross sectional opening as the slot they replace.

The invention is further illustrated by the following specific examples, which should not be taken as limitations on the scope of the invention

EXAMPLE 1

A dodecagonal melt-blowing die 1 having twelve spinnerette mounting surfaces 28 of 10×3.5 inches, and an edge 26 to edge 27 diameter of 13.523 inches as depicted in FIG. 1 and 2 was used. Twelve spinnerettes 24, each having eight rows of spinning nozzles 3 as illustrated in FIG. 3 were bolted to the mounting surfaces 28. The nozzle spacing was 0.045 inches, each spinnerette had 1776 spinning orifices. The total number of spinning orifices of this melt-blowing die was 21,312. Polypropylene of MFR 70 was supplied from an extruder to the die 1 at a rate of 3000 LB/hour under the following conditions:

| | |
|---|---|
| Extruder temperature (Degree F) | 450 |
| Die 1 temperature (Degree F) | 680 |
| Air temperature (Degree F) | 750 |
| Air pressure (PSI) | 30 |

An air ring 29 of 24 inches diameter was deflecting the circular, horizontal fiber 30 stream downward onto a moving collecting screen 25 which traveled at 33.9 feet per minute. The collected web 31 had a basis weight of 3607 gram per square meter, a thickness of 15 cm, and a web density of 0.024 gram/cubic cm or 1.5 LB/cubic foot. The fiber diameters ranged from 5 to 8 micrometers. The screen distance 37 from the die block 1 was 30 inches.

EXAMPLE 2

Example 1 was repeated except the polymer used was polyethylene terephthalate (PET) of 0.55 intrinsic viscosity, and the extruder temperature was 560 degree F. The collecting screen moved at 33.9 feet per minute; the web basis weight was 36 gram per square meter, at a web thickness of 20 cm. The web density as 0.018 gram per cubic cm or 1.1 LB per cubic foot. The fiber 30 diameters ranged from 4 to 8 micrometers.

EXAMPLE 3

Example 2 was repeated except that the deflecting air stream from air ring 29 contained an adhesive acrylic binder spray (Rohm & Haas, Rhoplex TR-407), depositing 12% by weight of dry latex onto the fiber 30; web drying was accomplished in a hot air stream of 230 degree F. for 3 minutes. The final web thickness was 20 cm, basis weight 4043 gram per square meter, and web density 0.020 gram per cubic cm or 1.2 LB per cubic foot.

EXAMPLE 4

Example 2 was repeated except that the deflecting air stream from air ring 29 was turned off on one side, fiber web was collected by a vertical collecting screen at a distance from the spinnerette 24 of 35 inches. The web had the following properties:

| | |
|---|---|
| Basis weight (gram per square meter) | 3610 |
| Web thickness (cm) | 6 |
| Web density (gram per cubic cm) | 0.060 |
| Web density (LB per cubic foot) | 3.7 |
| Fiber diameter (micrometer) | 4 to 8 |

EXAMPLE 5

In this Example the products of Examples 2 and 3 were compared in their respective compression recovery: On each sample of 24×24 inches a steel plate of same dimension and 0.125 inches thickness, weighing 20 pounds, was placed for ten minutes, after which the steel plate was lifted and removed. The thickness recovery of each sample, measured two minutes after removing the steel plate, is listed in Table 1:

TABLE 1

| | Example 2 (non-bonded) | Example 3 (bonded) |
|---|---|---|
| Basis weight (gram/sq. meter) | 3610 | 4043 |
| Initial thickness (cm) | 20 | 20 |
| Initial density (gram/cubic cm) | 0.018 | 0.020 |
| Final thickness (cm) | 8 | 18 |
| Final density (gram/cubic cm) | 0.045 | 0.022 |

DISCUSSION OF EXAMPLES

The present invention demonstrates a high capacity system for making high-loft, low-density fiber webs from thermoplastic polymers for insulation or cushioning applications. A comparison of Examples 1 and 2 shows PET producing a lower density web than polypropylene, which is more desirable for most applications. Comparing Examples 2 and 3 shows the improved compression recovery of the bonded web as listed in Table 1. Examples 2 versus 4 demonstrates the significance of the 90 degree deflection of the fibers by the secondary air stream, which causes higher entanglement and lower density. The combination of fiber deflection and adhesive bonding, using PET polymer represents the preferred embodiment of this invention. Looking at FIG. 4, the binder is supplied from storage tank 43 through metering pump 44 into the gas supply line 46 through the atomizer device 45 which sprays the binder as a fine mist into the gas stream from gas compressor 41 which is regulated by valve 42.

Figure 4:
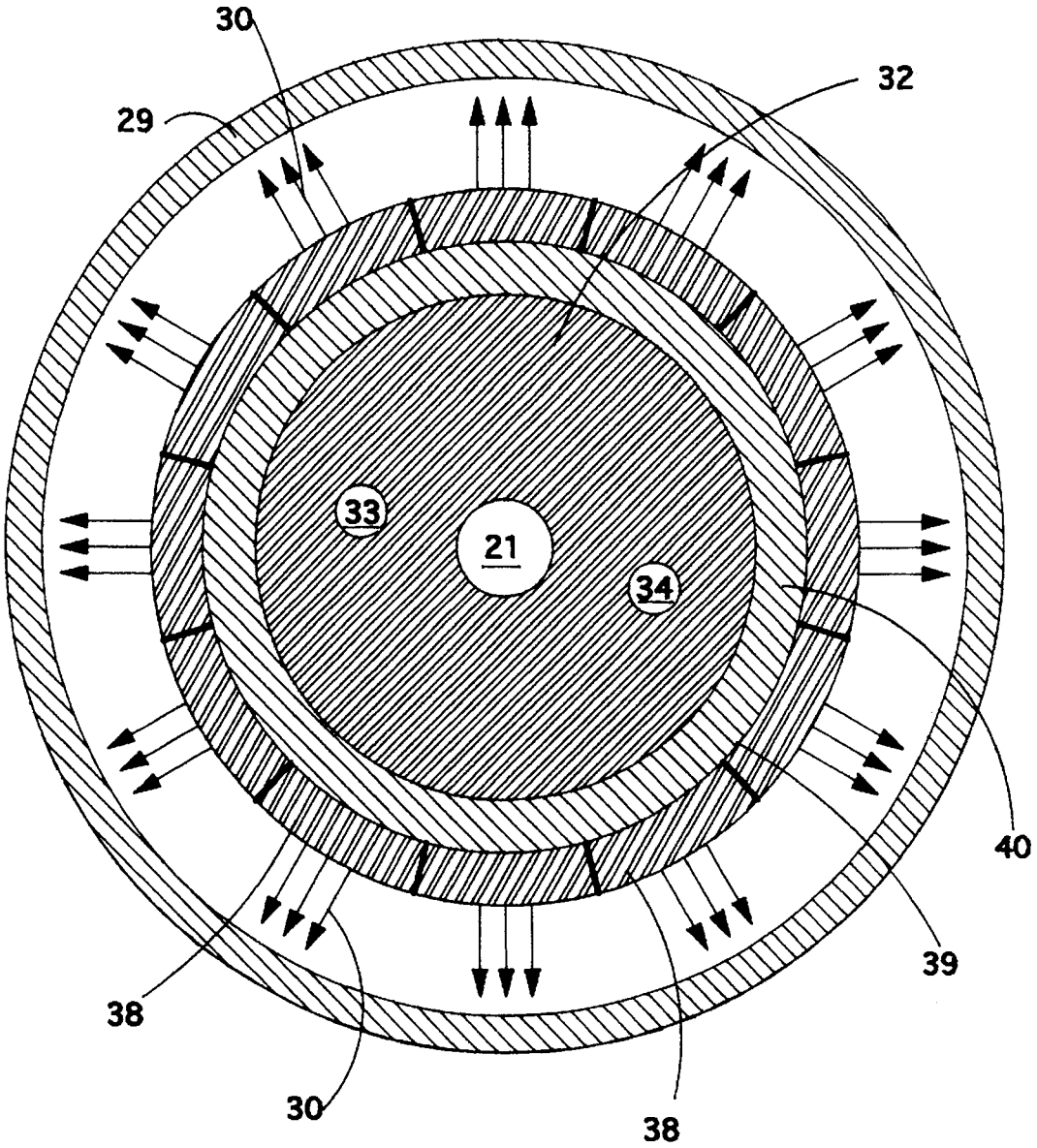
FIG. 4 is a top view of a cylindrical die block, where the spinnerettes have curved sealing surfaces matching the radius of the cylinder.

The polygonal die block 1 can have a multiplicity of spinnerettes 24 or can be cylindrical as shown in FIG. 4 where the multiplicity of spinnerettes 38 have curved surfaces to seal on the curved surface 39 of the fixed cylindrical die block 40.

The minimum edge-to-edge diameter (D) of a polygonal die block is:

$$D \text{ (in inches)} = \text{spinnerette width (in inches)} / \sin(180°/\text{No. of spinnerettes on polygon})$$

While the invention has been described in connection width several exemplary embodiments thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed is:

1. An apparatus for forming a low density fiber web, comprising:

a die head having a central polymer cavity supplying a molten polymer to spinnerettes, a multiplicity of spinnerettes operably joined to said polymer cavity so as to permit the spinning of polymer fibers through a multiplicity of spinnerettes in the die head, in directions that are radially outward from said polymer cavity, a central air supply operably connected to said spinnerettes so as to permit the providing of an attenuating air stream which will serve to carry said polymer fibers in a direction that is radially outward from said polymer cavity, an air ring that surrounds said apparatus and serves to project pressurized air in a direction that is contrary to the direction of the attenuating air stream so as to cause the polymer fibers carried therein to change direction approximately 90 degrees and become entangled, and a collection device positioned so as to receive the attenuating and entangled fibers and form a low density fiber web.

2. The apparatus of claim 1 wherein a multiplicity of said spinnerettes are placed around said die head so as to enable the spinning of said polymer fibers in a multiplicity of directions away from said die head.

3. The apparatus if claim 2 wherein said spinnerettes are positioned so as to form a polygon about said die head, and said die head has a polygonal cross section.

4. The apparatus of claim 2 wherein said spinnerettes have curved sealing surfaces and are positioned so as to form a circle about said die head, and said die head has a circular cross section.

5. The apparatus of claim 1 wherein said air ring is provided with a means for introducing a bonding agent into said air stream.

6. A process for forming a low density fiber web comprising the steps of:

providing a polymer melt to a polymer supply cavity centrally positioned in a die head, said supply cavity being operably joined through supply channels to a multiplicity of spinnerettes positioned to spin polymer fibers in a multiplicity of directions radially away from said die head, distributing pressurized gas from a central air supply to said spinnerettes, forming an attenuating gas stream which serves to attenuate said polymer fibers and to carry them in a multiplicity of directions radially away from said spinnerettes, forming a secondary gas stream by means of a gas ring which surrounds said die head and directs said secondary gas stream in a direction that is contrary to the direction of the attenuating air stream so as to cause the fibers carried therein to change direction approximately 90 degrees and become entangled, collecting said fibers on a collecting device, and forming a low density fiber web on said collecting device.

* * * * *